US006900399B1

(12) United States Patent
Wyatt et al.

(10) Patent No.: US 6,900,399 B1
(45) Date of Patent: May 31, 2005

(54) ELECTRICAL SWITCH ASSEMBLY

(75) Inventors: Christopher K. Wyatt, Hamilton, IL (US); Pat A. Bolen, Cathage, IL (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 10/874,261

(22) Filed: Jun. 24, 2004

(51) Int. Cl.[7] ..... H01H 27/00

(52) U.S. Cl. ..... 200/43.04; 200/43.07; 200/520; 200/533

(58) Field of Search ..... 200/16 R–16 D, 200/43.04, 43.06, 43.07, 43.09, 520, 533, 536, 573, 574, 334

(56) References Cited

U.S. PATENT DOCUMENTS 4,153,829 A * 5/1979 Murata ..... 200/533
4,300,026 A * 11/1981 Bull ..... 200/525
4,527,023 A 7/1985 Ohashi et al.
4,871,885 A * 10/1989 Kamada ..... 200/5 R
5,187,336 A 2/1993 Lang et al.
5,412,170 A * 5/1995 Hofmann et al. ..... 200/536
5,860,515 A 1/1999 Tomotoshi
5,960,939 A 10/1999 Miki et al.
6,486,423 B1 11/2002 Karasik et al.
6,559,400 B2 5/2003 Hayashi

* cited by examiner

*Primary Examiner*—Michael A. Friedhofer
(74) *Attorney, Agent, or Firm*—Blank Rome LLP

(57) ABSTRACT

An electrical switch assembly for actuating an electrical circuit by closing at least one pair of conducting contacts in a sliding manner is disclosed. The assembly includes a contact carrier within a switch housing, a spring attached to the carrier that biases the carrier in an electrical circuit open position, a slot connected to the carrier that receives a force transfer member, and a force transfer member that is insertable into the slot and transfers a force applied by a switch operator to an angled wall portion of the slot. The angle of the wall portion is preferably 45-degrees relative to the axis of travel of the force transfer member. In operation, when the force transfer member is inserted into the slot and pushes against the angled wall, the carrier is displaced approximately orthogonal to the insertion direction of the force transfer member to move the contacts in the carrier from an electrical circuit open position to an electrical circuit closed position.

22 Claims, 2 Drawing Sheets

ELECTRICAL SWITCH ASSEMBLY

BACKGROUND OF THE INVENTION

1. Field of the Invention

The present invention relates generally to electrical switches. More particularly, the present invention relates to an electrical switch assembly for a key-in warning system of a motor vehicle, the switch assembly having circuits that are closed by the movement of electrical contact pairs within the assembly in a direction that is transverse or oblique relative to the direction of the force applied to an actuating body inserted into the assembly.

2. Description of the Prior Art

A simple electrical-mechanical switch typically includes an insulated actuator connected to one or more electrical conducting contacts contained within a housing. The actuator may be a physical body that receives a force applied thereto by a switch operator. When the actuator body is displaced by the application of a force, the contact on the actuator moves relative to the housing and makes physical contact with a second contact within the housing, thereby closing an electrical circuit. Typically, the relative movement of the contact pairs is such that they abut against each other in the closed position.

This is the case, for example, in a simple button switch that has a switch head attached to a shaft that is itself attached to one-half of a contact pair. When a person presses a finger against the button switch head, it causes the button to displace the shaft, which causes the contact attached to the end of the shaft to likewise move until it abuts against the other half of the contact pair, thereby closing an electrical circuit.

For purposes of this discussion, a "circuit" is a combination of a number of electrical devices and conductors that, when interconnected to form a conducting path, fulfill some desired electrical or electronic function. An electrical switch can form a part of that conducting path. One problem with switches utilizing contacts that abut each other in the manner described above is that debris can build up on the adjacent surfaces of the contact pairs over time. The build-up of debris can reduce the reliability of the switch in terms of its ability to close an electrical circuit. Debris can find its way onto contacts through openings on the switch housing, such as openings around actuating members that extend from outside to inside the switch housing.

Another problem associated with contacts that abut against each other is that the contact pairs can become deformed if the actuator is displaced too much.

Still another problem with contact pairs that abut against each other is that a pair of contacts in such an arrangement is typically able to close only one circuit at a time.

One solution to those problems is to use a sliding switch assembly. U.S. Pat. No. 5,860,515 to Tomotoshi discloses one such sliding contact. In Tomotoshi, an actuator 10, as shown in FIG. 3, causes a switch-operating member 4 to slide along a rail 19 that is part of a frame body 7. Inside the frame body 7 is a fixed circuit board 1, as shown in FIG. 1. The operating member 4 is attached to a sliding board 3 that includes five contacts 21 that are in slidable contact with fixed contacts 11 on the circuit board 1. In operation, as the operating member 4 moves along the rail 19, the contacts 21 sweep across the surface of the circuit board 1. Depending on the relative position of the contacts 21 and fixed contacts 11, several different circuits may be closed at one time.

Although not described as an advantage of the disclosed invention, the sweeping action of the contacts 21 on the fixed contacts 11 can clean the portions of the contacts that physically touch each other and also prevent the contacts from being deformed.

U.S. Pat. No. 6,559,400 to Hayashi discloses a sliding switch assembly for use in a motor vehicle electrical system. In Hayashi, a slidable contact 15, as shown in FIGS. 2A–2C, moves parallel to base member 11 when a force component is applied in the longitudinal direction parallel to the slidable contact 15. Plate spring contacts 15E slide with the slidable contact 15 and contact the contact portions 12A and 14A, as best seen in FIG. 2C. The Hayashi sliding switch assembly is designed to close one of two different circuits, like those associated with a pair of motorized exterior rearview mirrors on a motor vehicle.

Both of the inventions disclosed in Tomotoshi and Hayashi involved sliding switches that are actuated primarily by an operator applying direct force to the actuator bodies of the respective switch assemblies using, most likely, a finger. However, other electrical switch assemblies for motor vehicles are actuated by a body or member that is interconnected to one or more different bodies or members, only one of which is actually touched by the vehicle operator. One example of this type of switch assembly is a key-in warning system switch. In the case of a key-in warning system switch, a plunger is used to cause an actuator to move electric contacts to close an electrical circuit. The plunger is in direct or indirect contact with the vehicle ignition key when the key is inserted into the ignition cylinder. Thus, the key, which the operator manipulates, is interconnected to the key-in warning switch actuator. The insertion or turning force applied to the key by the vehicle operator is transferred through interconnected members to the plunger that causes an actuator to engage the electrical contacts.

Force transfer actuators having multiple interconnected members are not new. U.S. Pat. No. 5,187,336 to Lang et al., for example, discloses a switch assembly with a transfer actuator. The switch assembly in Lang et al. has an external actuator arm 18, as shown in FIG. 1 of the patent, that causes internal component members to move relative to the switch housing when a force is applied to the actuator arm 18. Those component members then close an electrical circuit. The direction of the main component of the force applied to the actuator arm 18 is disclosed as being approximately orthogonal to the direction of the force that causes the member inside the housing to move.

In the case of a key-in warning switch assembly, the plunger is not directly connected to the switch housing but travels in a slot in the housing and causes electrical contacts to abut against each other and close an electrical circuit. One of the problems with this type of design, as noted above, is that the plunger can move too far and damage the contacts, plus there is no sweeping action to clear the contacts of debris that may build up.

SUMMARY OF THE INVENTION

In view of the foregoing, it should be apparent that there still exits a need in the art for an electrical switch assembly having an interconnected plunger member that is designed to prevent damage to electrical contacts and also causes electrical contacts to slide over, rather than abut against, each other.

It is an object of the invention, therefore, to provide an electrical switch assembly having electrical contacts interconnected to a body that receives a force applied by a switch operator, the force being transferred from the body to the contacts via one or more interconnected actuator members, one of which may be a plunger member.

More particularly, it is an object of the invention to provide a key-in warning electrical switch assembly for a motor vehicle having a key-in warning plunger that actuates the switch by transferring the force applied by a vehicle operator to an ignition key to a contact inside the switch assembly such that the contact slides relative to a mating contact, thereby closing an electrical circuit.

Still more particularly, it is an object of the invention to provide a slotted receptacle on an electrical switch assembly for receiving the end of a key-in warning plunger member, the slotted receptacle having a sloped wall that causes a contact carriage to move transversely or obliquely relative to the direction of the end of the plunger member upon insertion of the end of the plunger in the slotted receptacle.

These and other objects of the invention are accomplished in accordance with its apparatus aspects by providing an electrical switch assembly that is used to actuate an electrical circuit by closing at least one pair of conducting contacts in a sliding manner, the assembly including a contact carrier contained within a housing, the contact carrier having at least one conducting contact, a rail or bracket for the contact carrier to move on or between, a slot associated with or part of the contact carrier having an angled wall portion, a spring attached to the contact carrier for biasing the contact carrier in a circuit open position, one or more interconnected members for transferring a force applied by a switch operator to one of the interconnected members to the contact carrier, and a circuit board having at least one conducting contact corresponding to the conducting contact on the contact carrier.

The above and other objects of the invention are also accomplished in accordance with its apparatus aspects by providing a key-in warning electrical switch assembly that is used to actuate multiple circuits at one time, the assembly including a key-in warning plunger, a housing, a contact carrier contained within the housing, a rail or bracket for the contact carrier to move on or between, a spring attached to the contact carrier, a plurality of contacts positioned on the contact carrier, and a circuit board having a plurality of electrical contacts connected to electrical circuits that are in proximity to the plurality of contacts on the contact carrier.

The objects of the invention may also be accomplished in accordance with the method of using the invention. In operation, when a vehicle operator inserts a key into a key cylinder of a vehicle, the force applied to the key will be transferred to the key-in warning plunger either by direct or indirect physical contact. The transferred force applied to the key-in warning plunger will cause the end of the plunger to be inserted into a slot associated with or part of the contact carrier. The insertion direction will be at an angle relative to the longitudinal axis of the contact carrier. The end of the key-in warning plunger will impact an angled wall portion of the slot. As the plunger continues to be moved into the slot, the force being asserted on the plunger will be transferred to the angled wall of the slot and cause the contact carrier to be displaced along the rail or brackets holding the contact carrier in the housing of the switch assembly. The sliding action of the contact carrier will cause the plurality of contacts on the contact carrier to physical contact, in a sliding manner, the conducting contacts on the circuit board. If the slot on the sliding contact carrier is a hole, the end of the key-in warning plunger will extend past the angled wall and out the other side of the hole, never making direct physical contact with any of the electrical contacts or the circuit board inside the housing.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE INVENTION

Figure 1:
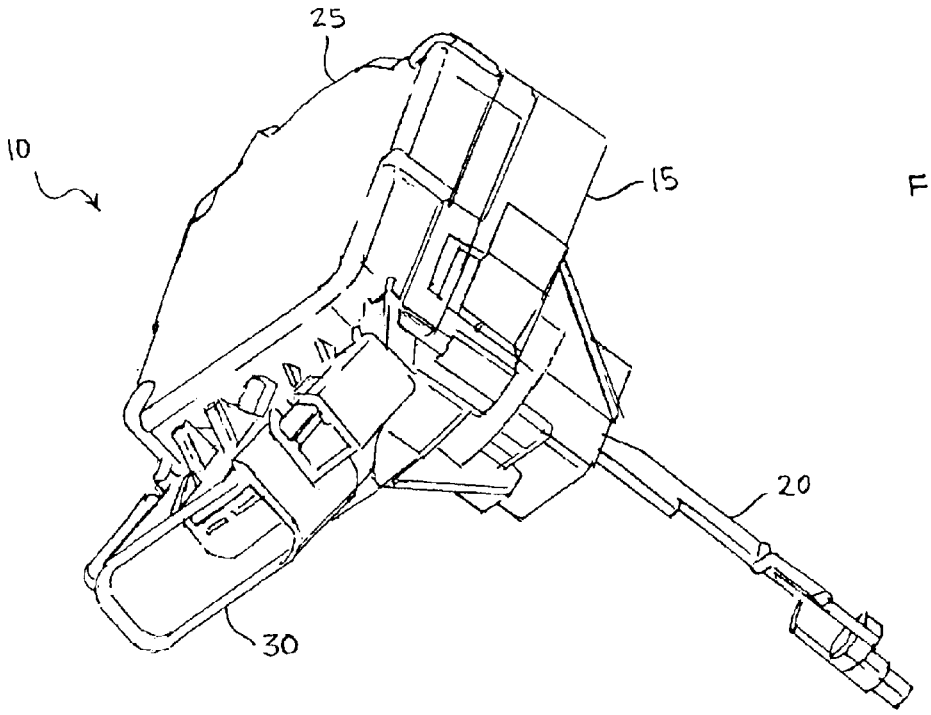
FIG. 1 is a perspective view of a key-in warning electrical switch assembly of the present invention.

Referring now in detail to the drawings, wherein like parts are designated by like reference numerals throughout, there is illustrated in FIG. 1 a perspective view of a key-in warning electrical switch assembly 10 of the present invention. The switch assembly 10 shown in FIG. 1 is a representation of a model year 2005.5 "WK/LX" ignition switch for a motor vehicle. That particular type of electrical switch assembly is used for illustrative purposes only. It should be understood that the present invention may be utilized on other types of electrical switches, including, but not limited to ignition switch assemblies.

The switch assembly 10 includes the switch 15 and a separate force transfer member 20 (shown being inserted into the switch 15). The switch 15 includes a housing 25 that is preferably made from a durable, lightweight, inexpensive and non-conductive material suitable for the environment in which the switch assembly 10 will operate. A thermoplastic material, such as a resin, or other polymeric substances are examples of preferred materials. Extending from and part of the housing 25 is a cable receptacle housing portion 30 for receiving a cable termination plug or adapter (not shown).

The force transfer member 20, as shown in FIG. 1, is essentially a longitudinally-extending device having distal and proximate ends and is also preferably made from a durable, lightweight, inexpensive and non-conductive material suitable for the environment in which the switch assembly 10 will operate. The particular shape and dimensions of the force transfer member 20 will depend on the position of the switch assembly 10 relative to the location of the applied force (e.g., an ignition key inserted into an ignition key cylinder (not shown)). Although only a single force transfer member 20 is shown in FIG. 1, one of ordinary skill in the art will appreciate that the force transfer member 20 may be formed from a series of interconnected members that cooperatively operate to transfer force applied to just one of the series of interconnected members.

Figure 2:
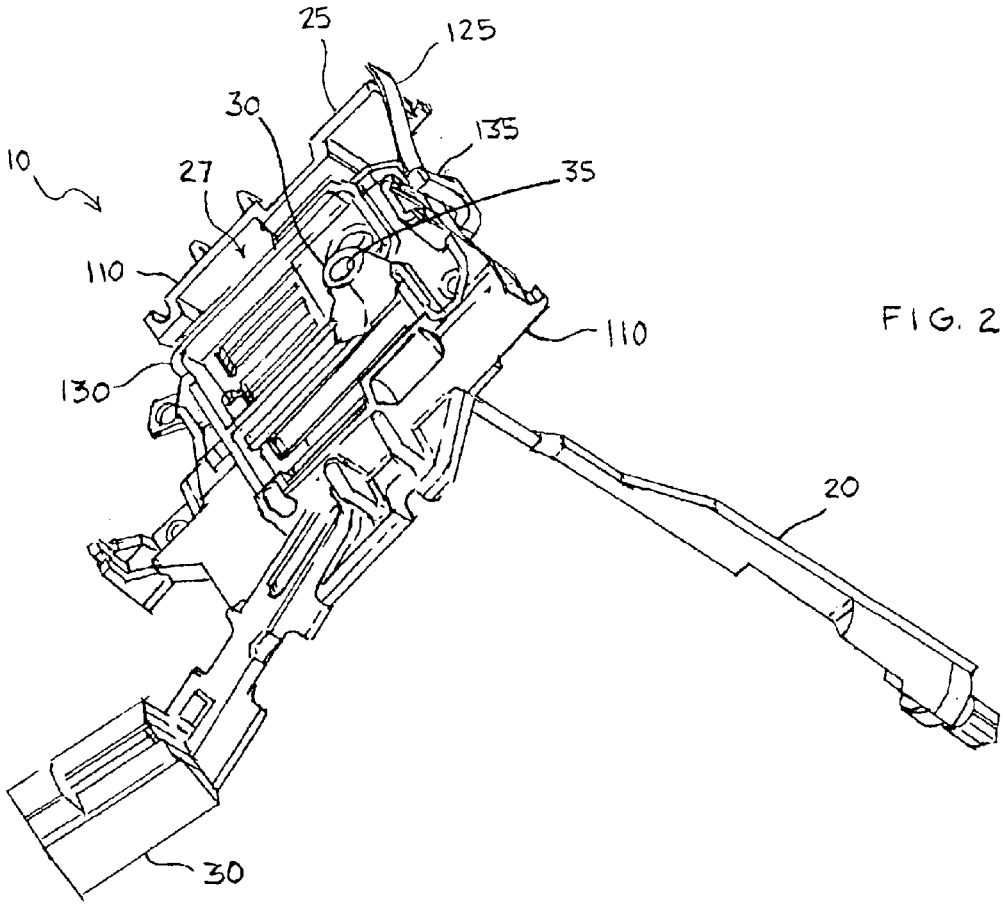
FIG. 2 is another perspective view of the key-in warning electrical switch assembly of FIG. 1.

FIG. 2 is another perspective view of the key-in warning electrical switch assembly 10 of FIG. 1, with part of the housing 25 removed to reveal a cavity 27 inside the housing 25. The housing 25 includes a slot 30 extending through the switch assembly 10 from one side of the switch assembly 10 to the other side. The slot 30 receives the distal tip of the force transfer member 20. Thus, the slot 30 preferably includes a through-hole 35 such that the distal tip of the force transfer member 20 can be inserted from one side of the slot 30 to the other side of the slot 30.

Also shown in FIG. 2 are a spring 125, the mid-span portion of which is attached to a sliding contact carrier 130 by way of a bracket 135 attached to the sliding contact carrier 130. As explained in more detail below, the sliding contact carrier 130 is positioned between a pair of guide rails 110.

Figure 3:
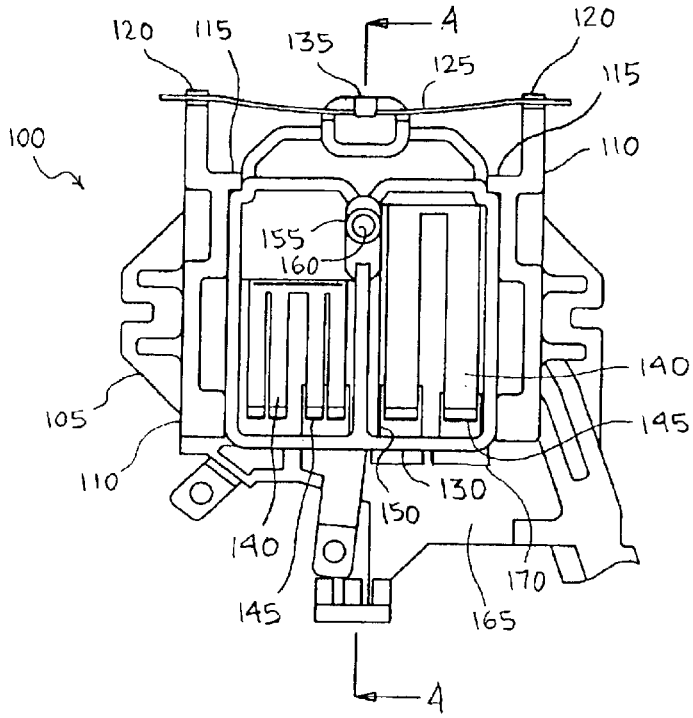
FIG. 3 is a plan view of a key-in warning electrical switch assembly of the present invention shown without a cover.

Referring now to FIG. 3, there is shown a plan view of a key-in warning electrical switch assembly 100 of the present invention shown without a cover. The switch assembly 100 includes a housing 102 that is preferably made, as noted above, from a durable, lightweight, inexpensive and non-conductive material. Integral with, or attached to, the housing 102 are a pair of guide rails 110 disposed on opposite edges of the same side of the switch assembly 100. The sides of the guide rails may form the walls of the switch assembly 100. A cover (not shown) for the housing 102 may be attached to the pair of guide rails 110 to enclose the interior space between the pair of guide rails 110.

Each of the pair of guide rails 110 includes a tab 115 and a bracket arm 120. Positioned between and slidably attached to the pair of bracket arms 120 is a spring 125. The spring 125 is preferably made of a lightweight, resilient metal. The mid-span portion of the spring 125 is attached to a sliding contact carrier 130, which is positioned between the pair of guide rails 110, by way of a bracket 135 attached to the sliding contact carrier 130. The spring 125 biases the sliding contact carrier 130 against the tabs 115 between the pair of guide rails 110.

The sliding contact carrier 130 includes one or more electrical conducting sliding contacts 140 attached thereto in a cantilevered manner such that the free ends of the sliding contacts are biased downward and are positioned in the openings 150 on the sliding contact carrier 130.

The sliding contact carrier 130 also includes a slot 155 that may or may not include a through hole 160. The slot 155 may be integral to the sliding contact carrier 130 or it may be a separate piece that is attached to or interconnected with the sliding contact carrier 130.

Finally, still referring to FIG. 3, there is shown a circuit board 165 positioned behind the sliding contact carrier 130 and the pair of guide rails 110. The circuit board 165 includes logic circuits (not shown) connected to circuit board contacts 170. The combination of the various sliding contacts 140 and the circuit board contacts 170 allows for more than one electrical circuit to be closed at the same time. For example, one of the sliding contacts 140 and one of the circuit board contacts 170 could be used to close a circuit that activates a key-in warning alarm and another of the sliding contacts 140 and circuit board contacts 170 could be used to close a circuit that activates an electronic steering column lock of a vehicle steering system.

Figure 4:
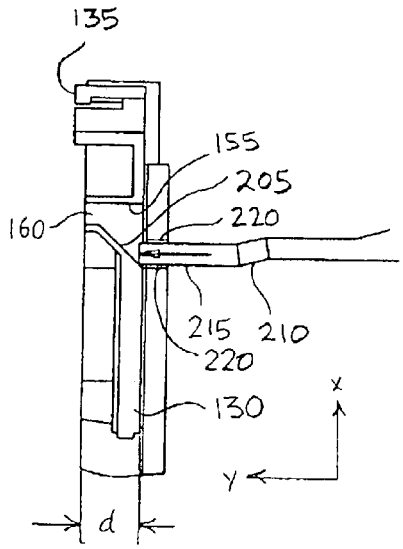
FIG. 4 is a cross-sectional view of the switch assembly of FIG. 3 viewed along line 4—4 in the direction shown.

Turning now to FIG. 4, shown therein is a cross-sectional view of the switch assembly 100 of FIG. 3 viewed along cross-section line 4—4 in the direction shown. The slot 155, as shown in this cross-sectional view, includes a slanted wall portion 205. A force transfer member 210, with a distal end 215, is adaptable to being inserted into the slot 155 in the direction shown by the arrow. The leading tip of the distal end 215 impacts the slanted wall portion 205 upon being inserted into the slot 155. The wall 220 of the slot 155 provides a guide for the force transfer member 210 and ensures that it is inserted into the slot 155 in approximately an orthogonal direction relative to the switch assembly 100 (i.e., normal to the plane formed by the sliding contact carrier 130). The wall 220 could be arranged so that the force transfer member 210 is insertable into the slot 155 at an oblique angle relative to the switch assembly 100.

The angle of the slanted wall portion 205 is preferably between 30 and 60 degrees (relative to the y-axis in the x-y coordinate system shown in FIG. 4). The optimal angle to use is a function of the distance the sliding contact carrier 130 is to travel in the x-direction and the incident angle of the tip of the distal end 215 of the force transfer member 210 as it traverses the slot 155 from one end to the other. The optimal angle may be determined by knowing the depth, d, of the slot 155 and the length of the slanted wall portion 205. The angle of the slanted wall portion 205 is preferably 45-degrees if the tip of the distal end 215 of the force transfer member 210 enters the slot 155 at a 0-degree angle relative to they-axis (i.e., as shown in FIG. 4).

Clearly, the relative angles of the slanted wall portion 205 and the insertion angle of the tip of the distal end 215 of the force transfer member 210 entering the slot 155 will limit the utility of the device. For example, if the tip of the distal end 215 of the force transfer member 210 enters the slot 155 at a 135-degree angle relative to they-axis and the angle of the slanted wall portion 205 is 45-degrees relative to the y-axis, the tip will impact the slanted wall portion 205 at a 90-degree angle relative to the slanted wall portion 205. If the tip of the distal end 215 of the force transfer member 210 enters the slot 155 at a 215 degree angle relative to the y-axis and the angle of the slanted wall portion 205 is 45-degrees relative to the y-axis, the tip will be parallel to the slanted wall portion 205. In either case, the sliding contact carrier 130 will not be displaced.

Figure 5:
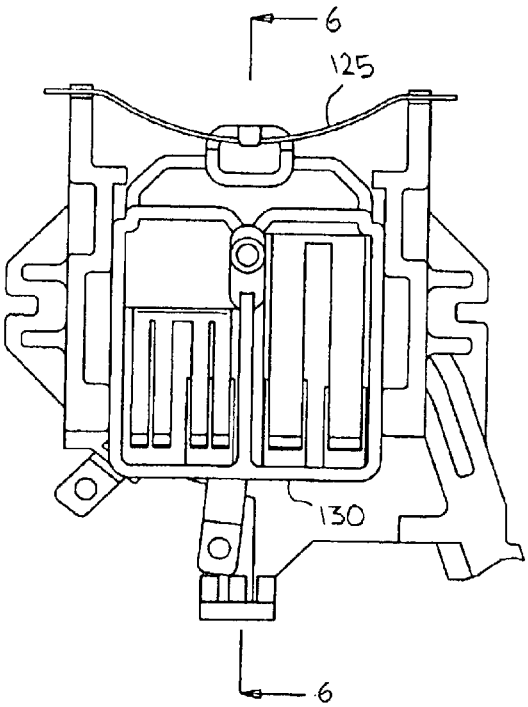
FIG. 5 is another plan view of the key-in warning electrical switch assembly of FIG. 3 showing an alternative position of the internal components of the switch assembly.
Figure 6:
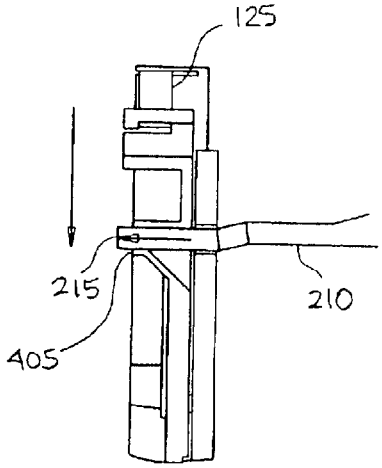
FIG. 6 is a cross-sectional view of the switch assembly of FIG. 5 viewed along line 6—6 in the direction shown.

FIG. 5 is another plan view of the switch assembly 100 of FIG. 3 showing the second position of the sliding contact carrier 130 after the force transfer member 210 is fully inserted into the slot 155 (as best seen in FIG. 6). The tip of the distal end 215 can extend beyond the edge 405 of the slot 155. In this position, the spring 125 is in its maximum tension state and the sliding contacts 140 are positioned over the circuit board contacts 170 such that the free ends 145 of the sliding contacts 140 slide over and physically contact the circuit board contacts 170. In this manner, the direction of the displacement of the sliding contacts 140 is transverse to the direction of the force applied to the force transfer member 210.

The operation of the switch assembly 100 will now be described in the context of the preferred embodiment shown in FIG. 3. In operation, when a vehicle operator inserts a key into a key cylinder of a motor vehicle (not shown), the force applied to the key will be transferred to the force transfer member 210 either by direct or indirect physical contact. The transferred force applied to the force transfer member 210 will cause the tip of the distal end 215 of the force transfer member 210 to be inserted into the slot 155 associated with or part of the contact carrier 130. The tip insertion direction should be at an angle relative to the longitudinal axis of the contact carrier 130. The tip of the distal end 215 of the force transfer member 210 will impact the slanted wall portion 205 of the slot 155. As the force transfer member 210 continues to be moved into the slot 155, the force being asserted on the force transfer member 210 will be transferred to the slanted wall portion 205 of the slot 155 and cause the contact carrier 130 to be displaced in the direction of the arrow (as best seen in FIG. 6).

The sliding action of the contact carrier 130 will cause the electrical conducting sliding contacts 140, which attached thereto in a cantilevered manner and biased downward, to protrude through the openings 150 and make physical contact, in a sliding manner, with the stationary circuit board contacts 170 on the circuit board 165. If the slot 155 on the sliding contact carrier is a hole, the tip of the distal end 215 of the force transfer member 210 will extend past the slanted wall portion 205 and out the other side of the hole, never making direct physical contact with any of the electrical contacts 140, 170 or the circuit board 165 inside the housing.

Although certain presently preferred embodiments of the present invention have been specifically described and shown herein, it will be apparent to those skilled in the art to which the invention pertains that many variations and modifications of the various embodiment shown and described herein may be made in light of the above teachings without departing from the spirit and scope of the invention. Accordingly, it is intended that the invention be limited only to the extent required by the appended claims and the applicable rules of law.

What is claimed is:

1. An electrical switch assembly for actuating an electrical circuit by closing at least one pair of conducting contacts in a sliding manner, the assembly comprising:

a contact carrier having longitudinal and transverse dimensions slidably attached within a housing;

a spring attached to the contact carrier and to the housing for biasing the contact carrier in an electrical circuit open position;

a slot connected to the contact carrier for receiving therein a force transfer member, wherein the slot has a wall portion positioned relative to the axis of travel of the force transfer member; and the force transfer member insertable into the slot for transferring a force applied by a switch operator to an angled wall portion of the slot, whereby the contact carrier is moved from an electrical circuit open position to an electrical circuit closed position.

2. The switch assembly according to claim 1, further comprising a rail or bracket attached to the housing, wherein the contact carrier is slidably attached to the rail or bracket.

3. The switch assembly according to claim 1, further comprising:

a first conducting contact attached to the contact carrier; and a second conducting contact, proximate to the first conducting contact, for completing an electrical circuit when the first and second contacts touch each other.

4. The switch assembly according to claim 3, further comprising a circuit board, wherein the second conducting contact is attached to the circuit board and forms part of an electronic circuit.

5. The switch assembly according to claim 1, wherein the force transfer member is a longitudinally-extending plunger having a substantially cylindrical body portion and first and second end portions, the first end portion being insertable in the slot.

6. The switch assembly according to claim 1, wherein the slot includes a through hole and wherein the axis of the through hole is orthogonal to or oblique relative to a plane formed by the longitudinal and transverse dimensions of the contact carrier.

7. The switch assembly according to claim 1, wherein the force transfer member insertable into the slot is insertable at an orthogonal or oblique angle relative to a plane formed by the longitudinal and transverse dimensions of the contact carrier.

8. The switch assembly according to claim 1, wherein the contact carrier, the housing, the spring, the slot and the force transfer member form part of a key-in warning switch for a motor vehicle ignition system.

9. The switch assembly according to claim 1, wherein the wall portion is at an angle between 30-degrees and 60-degrees relative to the axis of travel of the force transfer member.

10. The switch assembly according to claim 1, wherein the force applied by the switch operator to the angled wall portion of the slot causes the contact carrier to slide within the housing in a direction approximately parallel to the longitudinal dimension of the contact carrier.

11. An electrical switch assembly for actuating a key-in warning electrical circuit of a motor vehicle ignition system by closing at least one pair of conducting contacts in a sliding manner, the assembly comprising:

a contact carrier having longitudinal and transverse dimensions slidably attached within a housing;

a spring attached to the contact carrier and to the housing for biasing the contact carrier in an electrical circuit open position;

a slot connected to the contact carrier for receiving therein plunger means, wherein the slot has a wall portion at an angle relative to the axis of travel of the plunger means, and wherein the wall portion has an angle relative to the axis of travel of the plunger means between 30-degrees and 60-degrees; and the plunger means for transferring a force applied by a switch operator to the angled wall portion of the slot, wherein the force applied by the switch operator to the angled wall portion of the slot causes the contact carrier to slide within the housing in a direction approximately parallel to the longitudinal dimension of the contact carrier.

12. The switch assembly according to claim 11, further comprising a rail or bracket attached to the housing and slidably connected to the contact carrier.

13. The switch assembly according to claim 11, further comprising:

a first conducting contact attached to the contact carrier; and a second conducting contact, proximate to the first conducting contact, for completing an electrical circuit when the first and second contacts touch each other.

14. The switch assembly according to claim 13, further comprising a circuit board, wherein the second conducting contact is attached to the circuit board and forms part of a logic circuit.

15. The switch assembly according to claim 11, wherein the plunger means is a longitudinally-extending member having a substantially cylindrical body portion and first and second end portions, the first end portion being insertable in the slot.

16. The switch assembly according to claim 11, wherein the slot is a through hole on the contact carrier and wherein the axis of the through hole is orthogonal to or oblique relative to a plane formed by the longitudinal and transverse dimensions of the contact carrier.

17. The switch assembly according to claim 11, wherein the plunger means is insertable into the slot at an orthogonal or oblique angle relative to a plane formed by the longitudinal and transverse dimensions of the contact carrier.

18. An electrical switch assembly for actuating an electrical circuit by closing at least one pair of conducting contacts in a sliding manner, the assembly comprising:

an electrical switch housing;

contact carrier means for holding a first electrical contact within the housing;

spring means for biasing the contact carrier in an electrical circuit open position;

slot means in the contact carrier means for receiving therein a force transfer member;

circuit board means for holding a second electrical contact within the housing; and the force transfer member insertable into the slot means for transferring a force applied by a switch operator to an angled wall portion of the slot means and slidably engaging the first and second electrical contacts.

19. The switch assembly according to claim 18, wherein the force transfer member is a longitudinally-extending plunger having a substantially cylindrical body portion and first and second end portions, the first end portion being insertable in the slot means.

20. The switch assembly according to claim 18, wherein the force transfer member insertable into the slot is insertable at an orthogonal or oblique angle relative to a plane formed by a longitudinal dimension of the contact carrier means.

21. The switch assembly according to claim 18, wherein the slot means includes a wall portion having an angle between 30-degrees and 60-degrees relative to the axis of travel of the force transfer member.

22. The switch assembly according to claim 18, wherein the force applied by the switch operator to the angled wall portion of the slot means causes the contact carrier means to slide within the housing in a direction approximately parallel to the longitudinal dimension of the contact carrier means.

* * * * *